US009065212B2

(12) United States Patent
Golko et al.

(10) Patent No.: US 9,065,212 B2
(45) Date of Patent: Jun. 23, 2015

(54) CONNECTOR ARCHITECTURE AND INSERTION PROFILE

(75) Inventors: Albert J. Golko, Saratoga, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 122 days.

(21) Appl. No.: 13/607,462

(22) Filed: Sep. 7, 2012

(65) Prior Publication Data

US 2014/0073170 A1 Mar. 13, 2014

(51) Int. Cl.

| | |
|---|---|
| ***H01R 13/627*** | (2006.01) |
| ***H01R 13/631*** | (2006.01) |
| ***H01R 13/6582*** | (2011.01) |
| *H01R 24/60* | (2011.01) |

(52) U.S. Cl.

CPC ..... *H01R 13/631* (2013.01); *H01R 13/6275* (2013.01); *H01R 13/6582* (2013.01); *H01R 24/60* (2013.01)

(58) Field of Classification Search

CPC ..... H01R 13/6275; H01R 13/631; H01R 13/6582

USPC ..... 439/350–357, 660

See application file for complete search history.

(56) References Cited

U.S. PATENT DOCUMENTS

| | | | | |
|---|---|---|---|---|
| 7,094,089 | B2 * | 8/2006 | Andre et al. | 439/218 |
| 7,887,942 | B2 * | 2/2011 | Rejman et al. | 429/97 |
| 8,292,674 | B1 | 10/2012 | Yang et al. | |
| 8,398,416 | B2 * | 3/2013 | Tseng | 439/188 |
| 8,419,473 | B1 | 4/2013 | Lan et al. | |
| 8,430,695 | B2 | 4/2013 | Ting et al. | |
| 8,475,218 | B2 | 7/2013 | Zheng et al. | |
| 2003/0109151 | A1 | 6/2003 | Xu | |
| 2007/0105449 | A1 | 5/2007 | Murayama | |
| 2009/0280694 | A1 | 11/2009 | Zhuang et al. | |
| 2011/0013872 | A1 | 1/2011 | Zhang et al. | |
| 2013/0244496 | A1 | 9/2013 | Scritzky et al. | |
| 2013/0260615 | A1 | 10/2013 | Jol et al. | |

FOREIGN PATENT DOCUMENTS

| | | | |
|---|---|---|---|
| JP | 07-33395 | Y2 | 7/1995 |
| WO | 2011/150403 | A1 | 12/2011 |
| WO | 2011/150403 | A9 | 12/2011 |
| WO | 2011/163256 | A1 | 12/2011 |

OTHER PUBLICATIONS

International Search Report and Written Opinion mailed on Jun. 28, 2013 for PCT Patent Application No. PCT/US2013/036656, 15 pages.

(Continued)

*Primary Examiner* — Khiem Nguyen

(74) *Attorney, Agent, or Firm* — Kilpatrick Townsend & Stockton LLP

(57) ABSTRACT

Connector inserts and receptacles that provide a clear response to a user when a connector insert is properly inserted into a connector receptacle. One example may provide a connector system that provides a tactile response to a user when a connector insert is properly inserted into a connector receptacle. In other examples, the response provided to the user may be audible as well. The insertion of the connector insert into the connector receptacle may follow a force profile that includes an insertion profile defined by a substantially monotonically increasing resistance force from the beginning of insertion until an insertion peak is reached, followed by a click-through event leading to a final mating position.

21 Claims, 8 Drawing Sheets

(56) References Cited

OTHER PUBLICATIONS

International Search Report and Written Opinion mailed on Jun. 2, 2013 for PCT Patent Application No. PCT/US2013/025599, 10 pages.

Notice of Allowance mailed on Jul. 21, 2014 for U.S. Appl. No. 13/629,477, 11 pages.

Notice of Allowance mailed on Aug. 4, 2014 for U.S. Appl. No. 13/607,439, 12 pages.

* cited by examiner

CONNECTOR ARCHITECTURE AND INSERTION PROFILE

CROSS-REFERENCES TO RELATED APPLICATIONS

This application is related to U.S. provisional application 61/694,423, filed Aug. 29, 2012, and U.S. application Ser. No. 13/607,439, filed Sep. 7, 2012, which are incorporated by reference.

BACKGROUND

Each time a user interacts with an electronic device, the user may make an evaluation regarding the quality of the device. A pleasant experience may inform a positive evaluation by the user, and, after a time, the user may gain the impression that the device is of high quality and that the company making the device can be trusted to build reliable a devices. Such an interaction may occur each time a user inserts a connector insert into a receptacle on an electronic device.

Electronic devices often communicate and receive power over cable assemblies. These cable assemblies may include connector inserts, or plugs, on one or more ends of a cable. The connector inserts may plug into connector receptacles on electronic devices, thereby forming one or more conductive paths for signals and power.

Often, connector inserts are inserted by a user into a connector receptacle by simply pushing the connector insert into the receptacle until it cannot be inserted any further. This may leave the user unsure as to whether a connection has been made. This unsatisfactory experience may reflect poorly on the electronic device and may create doubt about the electronic device with the user.

Instead of simply pushing a connector insert into a connector receptacle until it cannot be inserted any further, it may be useful if there was some sort of unambiguous response provided to the user when a connector insert is properly inserted into a connector receptacle. If the connector insert is pleasant to insert connector receptacle, the user may gain a favorable impression.

Thus, what is needed are connector systems that provide a clear response to the user when a connector insert is properly inserted into a connector receptacle.

SUMMARY

Accordingly, embodiments of the present invention may provide connector systems that provide a clear response to a user when a connector insert is properly inserted into a connector receptacle. An illustrative embodiment of the present invention may provide a connector system that provides a tactile (by feel) response to a user when a connector insert is properly inserted into a connector receptacle. In various embodiments of the present invention, the response provided to the user may be audible as well.

An illustrative embodiment of the present invention provides a connector system including a connector insert and a connector receptacle. The insertion of the connector insert into the connector receptacle may follow a force profile that includes a tactile response that may be detected by a user. This force profile may include an insertion profile defined by a substantially monotonically increasing resistance force from the beginning of insertion until an insertion peak is reached, followed by a click-through event and leading to a final mating position. In this embodiment, a tactile response may be provided by this singular click-through event during insertion. The insertion profile may further include a bottoming-out portion, wherein the insertion force increases as the connector insert is inserted beyond the final mating point and the connector insert bottoms out in the connector receptacle.

The force profile of this connector system may further include an extraction profile. The extraction profile may be defined by an increasing resistance force leading to an extraction peak resistance, followed by a decreasing resistance force until the connector insert is removed from the connector receptacle.

In various embodiments of the present invention, the insertion and extraction peak resistance forces may have various values. In a specific embodiment of the present invention, the peak forces may be approximately 1 kg, though they may have a range of values, for example from 0.5 to 1.5 kg. They may also have different values. The click-through event may lead to a final mating position force that is less than 15 percent of the peak resistance force. This difference in resistance may provide a tactile, and perhaps audible, response to the user informing the user that the connector insert has been properly inserted into the connector receptacle.

Another illustrative embodiment of the present invention may provide a connector receptacle having a latch forming two ground or other types of contacts. These ground contacts may engage a curved leading edge of a connector insert during the beginning of insertion. These ground contacts may substantially provide the insertion resistance during this time. This may result in a substantially monotonically increasing resistance force leading to an insertion peak, which may occur when the ground contacts reach a side of the connector insert.

In this embodiment of the present invention, as the connector insert continues to be inserted, the ground contacts may reach detents on sides of the connector insert. At this point, the resistance may rapidly decrease with further insertion of the connector insert, resulting to a click-through event. This click-through event may result in providing a tactile, and possibly audible, response to the user.

To increase the monotonicity of the force profile leading to the insertion peak, other contacts in the connector receptacle may be positioned to not engage the connector insert until the click-through event has been reached. By positioning the other contacts in this way, forces involved in their interaction with the connector insert are not felt during insertion before the insertion peak. Instead, they occur during the click-through event where they are not as noticeable.

In this embodiment of the present invention, the other contacts may be signal contacts, and they may include contacts for signals, power, ground, and other types of control, bias, and other signals. The ground (or other or other types of) contacts may be located on sides of the connector insert, while the other or signal contacts may be located on a bottom of the receptacle.

Another illustrative embodiment of the present invention may provide a connector insert. This connector insert may include a front having curved leading edges that curve from the front to the sides. Detents forming retention surfaces may be located on each side of the connector insert. The curved leading edges may curve to the point where the detents begin. This may result in an absence of a flat area between the curved leading edges and the detents. This may, in turn, provide an insertion force profile where a click-through event directly follows a peak insertion resistance force, thereby improving the user's interaction experience.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
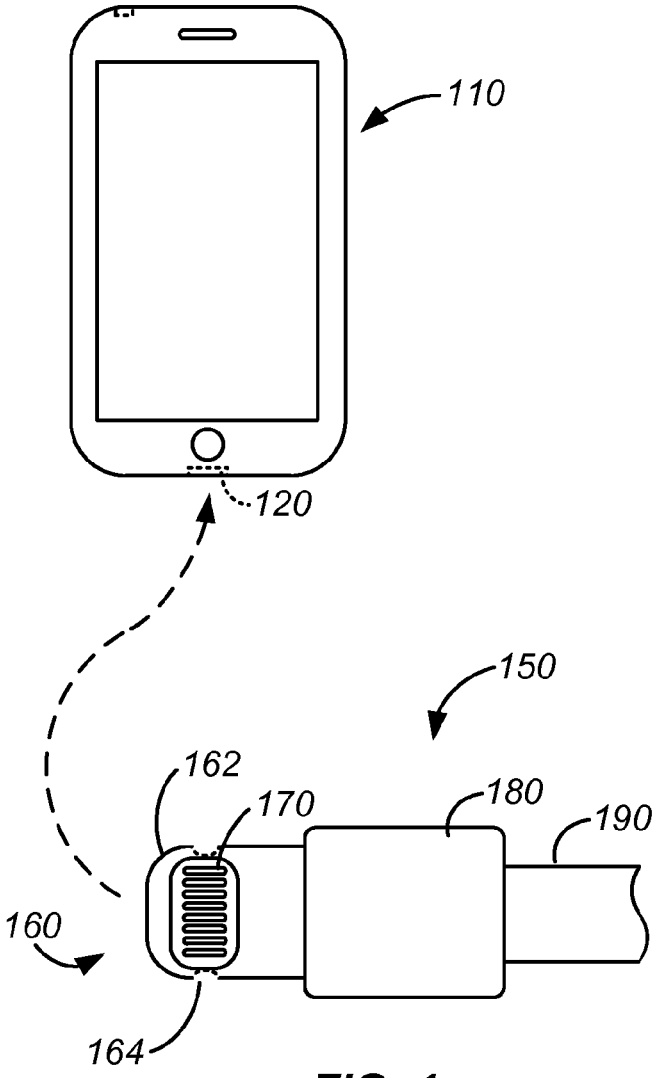
FIG. 1 illustrates a connector system according to an embodiment of the present invention.

FIG. 1 illustrates a connector system according to an embodiment of the present invention. This figure, as with the other included figures, is shown for illustrative purposes and does not limit either the possible embodiments of the present invention or the claims.

A connector system according to an embodiment of the present invention may include connector receptacle 120 and connector insert 150. In this example, connector receptacle 120 is housed in an electronic device 110. Electronic device 110 is shown here as a smart phone, though it may be a device such as a portable computing device, tablet, desktop, and all-in-one computer, cell or media phone, storage device, portable media player, navigation system, monitor or other device consistent with embodiments of the present invention.

Connector insert 150 may include insert portion 160, housing 180, and cable 190. Insert portion 160 may include curved leading edges 162, detents 164, and contacts 170. Connector insert housing 180 may be held by a user when connector insert 150 is inserted into connector receptacle 120. Cable 190 may include conductors to convey power and signals between electronic device 120 and another electronic device or power supply. Further details on connector insert 150 may be found in U.S. provisional application No. 61/694,423, filed Aug. 29, 2012, which is incorporated by reference. Further details on connector receptacle 120 may be found in U.S. application Ser. No. 13/607,439, filed Sep. 7, 2012, which is incorporated by reference.

Figure 2:
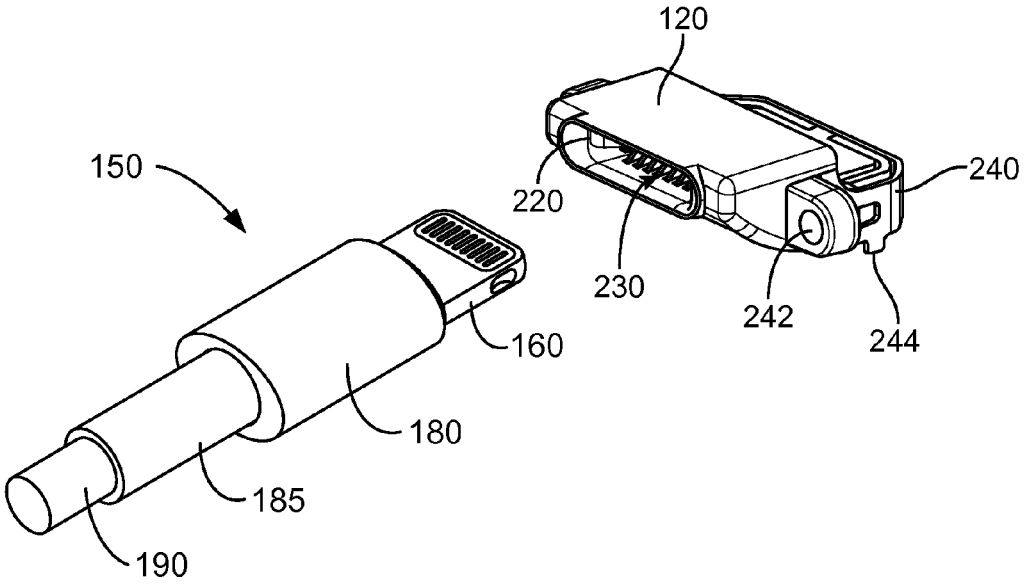
FIG. 2 illustrates a connector system according to an embodiment of the present invention.

FIG. 2 illustrates a connector system according to an embodiment of the present invention. This figure includes connector receptacle 120 and connector insert 150. Connector receptacle 120 may include side ground (or other type of) contacts 220 and signal contacts 230. Connector receptacle 120 may further include a bracket 240 having openings 242 to accept fasteners that may be used to attach connector receptacle 120 to electronic device 110. Bracket 240 may further include tabs 242 which may be soldered or fixed to a main logic board, motherboard, flexible circuit board, or other appropriate substrate.

Connector insert 150 may include insert portion 160, housing 180, and cable 190 as before. Connector insert 150 may further include strain relief 195 to protect cable 190.

Figure 3:
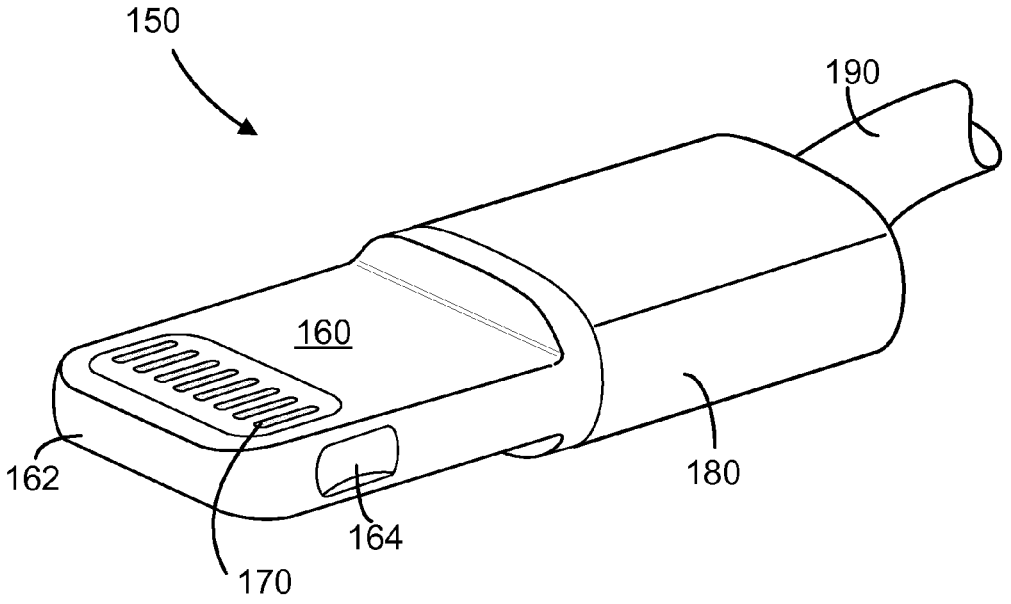
FIG. 3 illustrates another view of a connector system according to an embodiment of the present invention.
Figure 3:
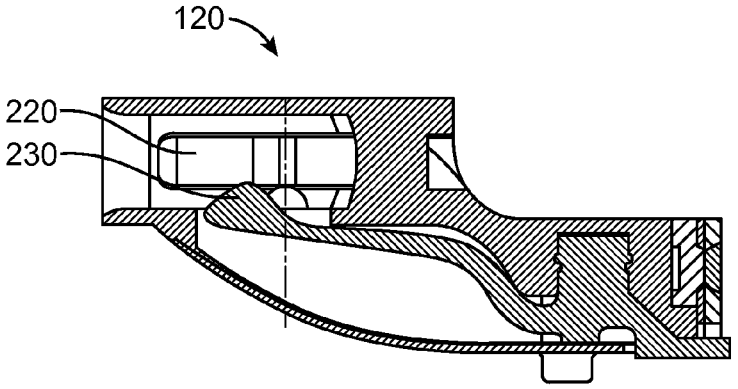

FIG. 3 illustrates another view of a connector system according to an embodiment of the present invention. Connector receptacle 120 may again include side ground contacts 220 and signal contacts 230. Side ground contacts 220 may be formed by ends of a latch piece. Details of these latches may be found in co-pending U.S. patent application Ser. No. 13/607,439, filed Sep. 7, 2012, which is incorporated by reference. Connector insert 150 again may include insert portion 160 having curved leading edges 162, detents 164, and contacts 170. Connector insert 150 may further include housing 180 and cable 190.

When connector insert 150 is inserted into connector receptacle 120, ground contacts 220 may reside in detents 164 on the connector insert 150. Contacts 170 on connector insert 150 may mate with contacts 230 in connector receptacle 120.

Again, upon insertion of connector insert 150 into connector receptacle 120, it may be desirable to provide a clear, positive response to the user informing the user that connector insert 150 has been properly inserted into connector receptacle 120. A force curve that provides such a positive response is shown in the following figure.

Figure 4:
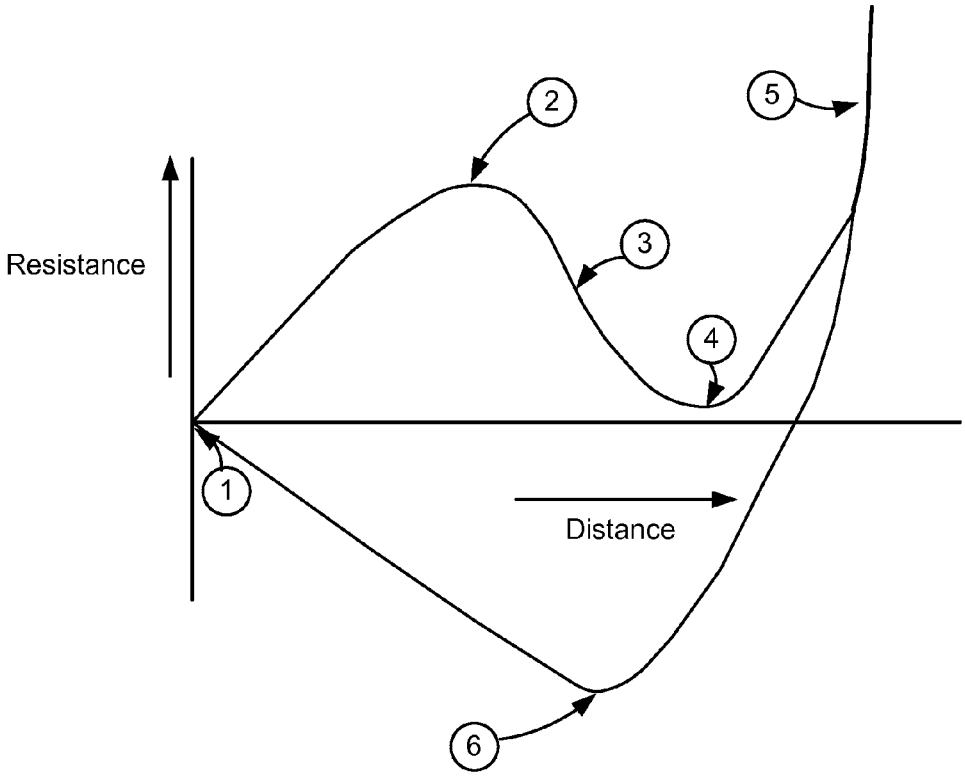
FIG. 4 illustrates a force curve for a connector system according to an embodiment of the present invention.

FIG. 4 illustrates a force curve for a connector system according to an embodiment of the present invention. This force curve illustrates resistance as a function of a distance that connector insert 150 is inserted into connector receptacle 120. At location 1, connector insert 150 is beginning to be inserted into connector receptacle 120. As connector insert 150 is inserted further into connector receptacle 120, side ground contacts 220 may deflect, thereby increasing the resistance to the insertion. This insertion resistance may substantially monotonically increase to an insertion peak, shown here as location 2.

As connector insert 150 progresses further, a click-through event occurs, and connector insert 150 transitions through location 3 to location 4, which may be its final mating location. The transition from location 2 to location 4 may be referred to as a click-through event. This click-through event may provide a tactile, and possibly audible, response to the user inserting connector insert 150 into connector receptacle 120.

As connector insert 150 is pushed further into connector receptacle 120, connector insert 150 may bottom out in connector receptacle 120, and the resistance force may begin to increase rapidly, shown here as location 5.

As connector insert 150 is extracted from connector receptacle 120, the extraction resistance force may increase until an extraction peak, shown here as location 6, is reached. Beyond that, the extraction resistance may taper off until connector insert 150 is extracted from connector receptacle 120.

In various embodiments of the present invention, the insertion peak and extraction peak shown here may have various values. In a specific embodiment of the present invention, these peaks values may be 1 kg, though in other embodiments of the present invention, they may have different values or different ranges of values. To provide a distinct click feel, the resistance at location 4 may be less than 15% of the peak value at location 2. This relatively large difference in resistance values may provide a clear tactile response to the user. The transition distance from location 2 to location 4 may be approximately 1 mm in various embodiments of the present invention. During extraction, the distance to the extraction peak value at location 6 may be approximately 0.5 mm, though other ranges and values for these distances may be realized consistent with embodiments of the present invention.

Embodiments of the present invention provide connector inserts and connector receptacles that are capable of providing a force profile such as the force profile shown in this figure. Examples of how this force profile may be achieved are shown in the following figures.

Figure 5A:
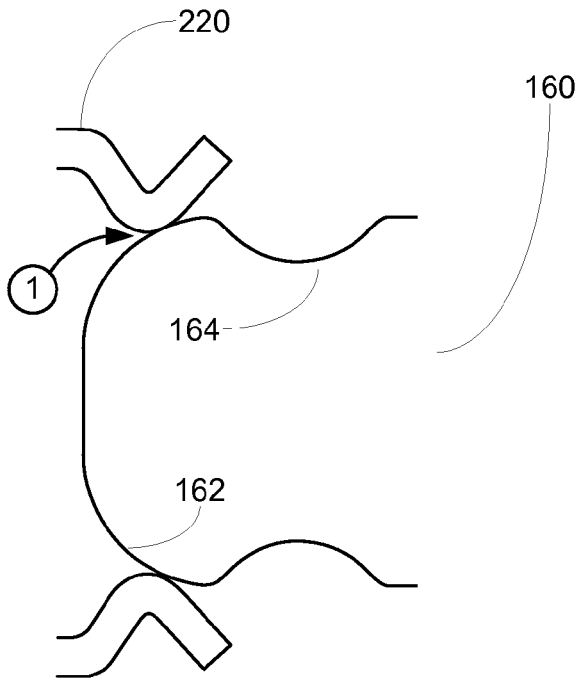
FIGS. 5A and 5B illustrate portions of a connector system according to an embodiment of the present and invention.
Figure 5B:
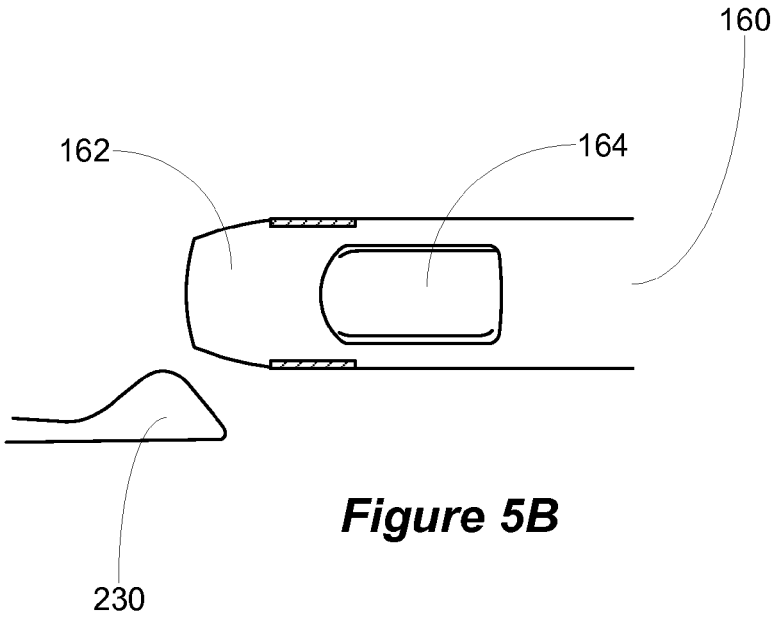

FIGS. 5A and 5B illustrate portions of a connector system according to an embodiment of the present and invention. FIG. 5A illustrates a top view, while FIG. 5B illustrates a side view. For clarity, only ground contacts 220 and signal contacts 230 are shown from connector receptacle 120. From connector insert 150, insert portion 160 including curved leading edges 162 and detents 164 are shown.

In FIG. 5A, curved leading edges 162 of connector insert portion 160 have begun to encounter ground contacts 220. In FIG. 5B, contacts 230 have not yet encountered connector insert portion 160.

Figure 6A:
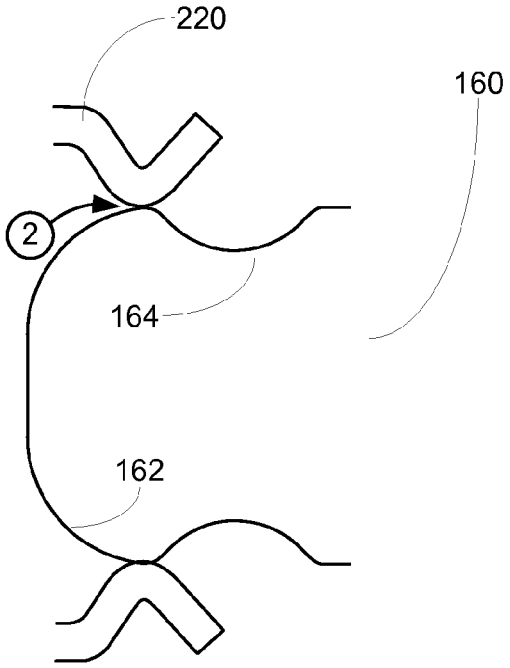
FIGS. 6A and 6B illustrate portions of connector system according to an embodiment of the present invention.
Figure 6B:
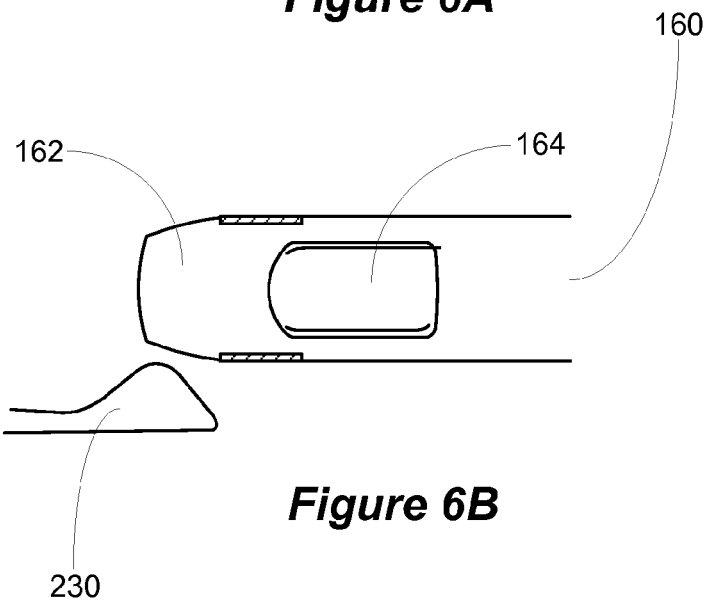

FIGS. 6A and 6B illustrate portions of connector system according to an embodiment of the present invention. In FIG. 6A, ground contacts 220 have reached a peak at the junction between curved leading edge is 162 and detents 164. FIG. 6B, contacts 230 have not yet encountered connector insert portion 160.

The passage of ground contacts 220 along the curved leading edges 162 of connector insert 150 may result in the increase in resistance from location 1 to location 2 in the force curve of FIG. 4. Since contacts 230 have not encountered connector insert 150, the rise from location 1 to location 2 may be substantially monotonic and not be disrupted by spurious forces that may result due to such contact.

Figure 7A:
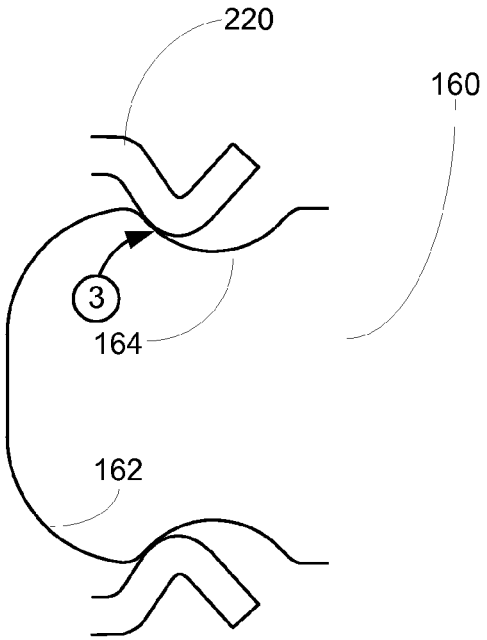
FIGS. 7A and 7B illustrate portions of a connector system according to an embodiment of the present invention.
Figure 7B:
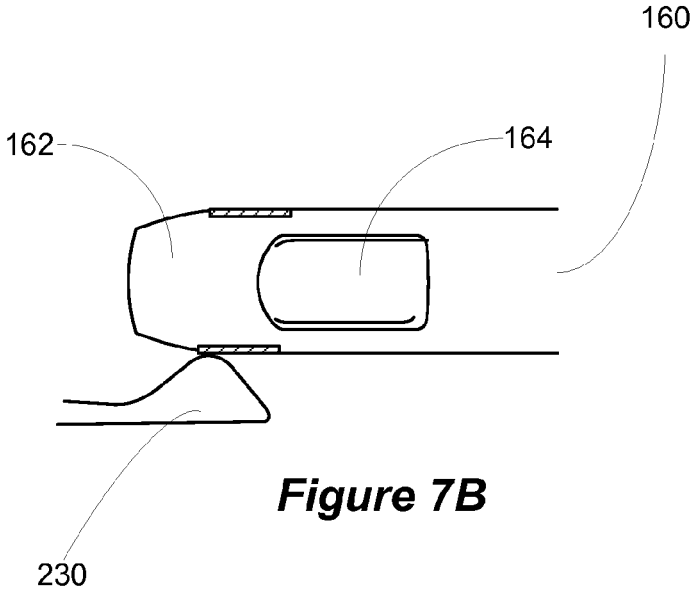

FIGS. 7A and 7B illustrate portions of a connector system according to an embodiment of the present invention. In FIG. 7A, ground contacts 220 begin to enter detents 164. In FIG. 7B, contacts 230 have begun to encounter connector insert portion 160.

Figure 8A:
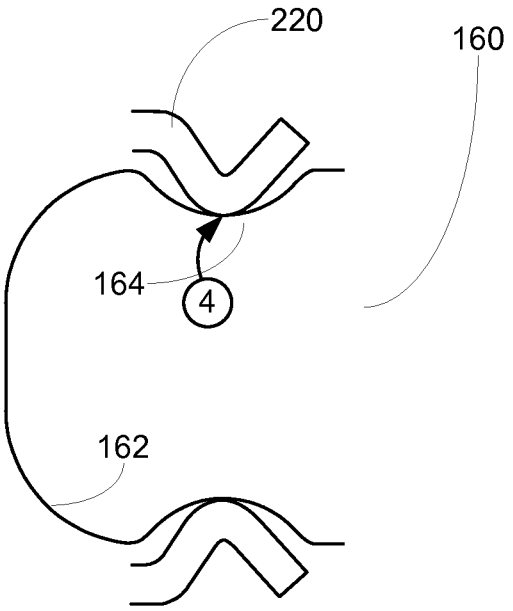
FIGS. 8A and 8B illustrate portions of connector system according to an embodiment of the present invention.
Figure 8B:
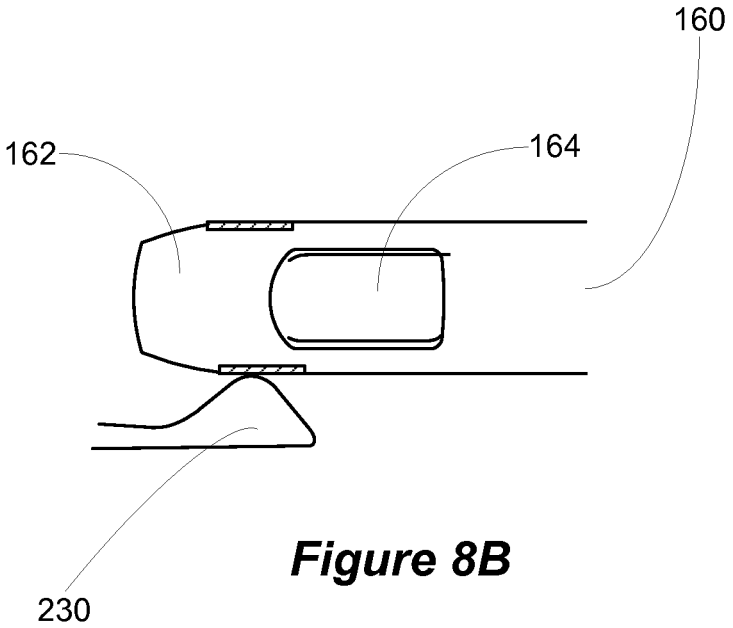

FIGS. 8A and 8B illustrate portions of connector system according to an embodiment of the present invention. In FIG. 8A, ground contacts 220 have reached their final mating point in detents 164. Contacts 230 have mated with contacts 170 on connector insert portion 160.

The transition from location 2 to location 4 results in a large different in resistance. This large change may result in a clear tactile, and possibly audible, response to the user informing the user that the connector insert is properly inserted in connector receptacle 120.

In various embodiments of the present invention, the dimensions of connector insert 150 may vary. For example, if curved leading edges 162 of connector insert 150 are too steep, the force curve from location 1 to location 2 may be excessive and may not feel right to a user. If curved leading edges 162 are too shallow, connector insert 150, and therefore connector receptacle 120, may become excessively long and waste space inside electronic device 110.

Also, embodiments of the present invention may arrange curved leading edges 164 to curve right to the edge of detents 164. In this way, there is no substantial flat spot in the force curve of FIG. 4 near insertion peak 2. Such a flat spot may feel odd to a user and may make the user prematurely believe that insertion is complete.

The slope of detents 164 may also be adjusted consistent with embodiments of the present invention. For example, if detents 164 are too shallow, the click-through event may be diminished. If detents 164 are too deep, the extraction peak location 6 may be excessive, which may result in an undesirable feel.

As seen above, side ground contacts 220 and signal contacts 230 may be placed relative to each other to improve connector system operation. For example, signal contacts 230 may be located where they do not encounter connector insert 150 until connector insert 150 is in position for the click-through event. This may help bury the forces created by contact between signal contacts 230 and connector insert 150 such that they do not have a significant effect on the force profile curve of FIG. 4.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

an insert portion comprising:

a front, two sides, and a top and a bottom, where the front includes two curved leading surfaces, each leading to one of the sides, such that the insert encounters a substantially monotonically increasing resistance force from a beginning of insertion of the insert into a corresponding receptacle until a peak is reached; the insert portion further comprising:

two detents, one on each side of the insert portion, the detents forming curved retention surfaces, such that a click-through event follows the peak as the insert continues to be inserted, which is followed by a final mating point, wherein a resistance at the final mating point is less than fifteen percent of the peak;

wherein the curved leading surfaces extend to the curved retention surfaces on each side of the insert portion.

2. The connector insert of claim 1 wherein the curved leading surfaces extend to the curved retention surfaces on each side of the insert portion such that there is substantially no flat surface between curved leading edges and the curved retention surfaces on each side of the insert portion.

3. The connector insert of claim 1 further comprising a connector insert housing to be grasped by a user when inserting the connector insert into a connector receptacle.

4. The connector insert of claim 1 further comprising a plurality of contacts, the contacts located on a top surface of the insert portion and a bottom surface of the insert portion.

5. The connector insert of claim 4 wherein the plurality of contacts are surrounded by a ground ring.

6. The connector insert of claim 5 wherein the curved leading edges and detents are formed in the ground ring.

7. The connector insert of claim 6 wherein the ground ring is metallic.

8. A connector system comprising:

a connector insert comprising an insert portion, the insert portion comprising:

a front, two sides, and a top and a bottom, where the front includes two curved leading surfaces, each leading to one of the sides, such that the insert encounters a substantially monotonically increasing resistance force from a beginning of insertion of the insert into a corresponding receptacle until a peak is reached; and two detents, one on each side of the insert portion, the detents forming curved retention surfaces, such that a click-through event follows the peak as the insert continues to be inserted, which is followed by a final mating point, wherein a resistance at the final mating point is less than fifteen percent of the peak;

wherein the curved leading surfaces extend to the curved retention surfaces on each side of the insert portion; and a connector receptacle comprising:

a plurality of first contacts to mate with the detents on the connector insert; and a plurality of second contacts, each to mate with a corresponding contact on the connector insert, wherein the second contacts are positioned relative to the first contacts such that during insertion of a connector insert into the connector receptacle, the second contacts engage the connector insert after the first contacts reach the detents on the connector insert.

9. The connector insert of claim 8 wherein the curved leading surfaces extend to the curved retention surfaces on each side of the insert portion such that there is substantially no flat surface between curved leading edges and the curved retention surfaces on each side of the insert portion.

10. The connector insert of claim 8 further comprising a connector insert housing to be grasped by a user when inserting the connector insert into a connector receptacle.

11. A connector system including a connector insert and a connector receptacle, the connector receptacle having side ground contacts to engage the connector insert when the connector insert is inserted into the connector receptacle;

the connector insert having a curved front edge such that the connector insert encounters a substantially monotonically increasing resistance force from a beginning of insertion until a peak is reached; and the connector insert having side retention detents such that the connector insert encounters a click-through event following the peak as the connector insert is further inserted into the connector receptacle, which is followed by a final mating point as the connector insert is further inserted into the connector receptacle, wherein a resistance at the final mating point is less than fifteen percent of the peak.

12. The connector system of claim 11 wherein the peak is approximately a 1 kg force.

13. The connector system of claim 11 wherein the monotonically increasing force is due to a ground contact in the connector receptacle being deflected by a curved leading edge of the connector insert.

14. The connector system of claim 13 wherein the click-through event is due to the ground contact in the connector receptacle engaging a detent on a side of the connector insert.

15. The connector system of claim 11 wherein the click-through event provides a tactile response that the connector insert is properly inserted in the connector receptacle.

16. The connector system of claim 11 wherein the click-through event provides an audible response that the connector insert is properly inserted in the connector receptacle.

17. The connector insert of claim 1 wherein the peak is approximately a 1 kg force.

18. The connector insert of claim 1 wherein the click-through event provides a tactile response that the connector insert is properly inserted in the connector receptacle.

19. The connector insert of claim 1 wherein the click-through event provides an audible response that the connector insert is properly inserted in the connector receptacle.

20. The connector system of claim 8 wherein the peak is approximately a 1 kg force.

21. The connector system of claim 8 wherein the click-through event provides a tactile response that the connector insert is properly inserted in the connector receptacle.

* * * * *